United States Patent [19]

Hay et al.

[11] 4,095,207

[45] June 13, 1978

[54] THERMAL FUSE

[75] Inventors: Warren H. Hay, Hamilton; Stephen F. Kimball, Georgetown; Roy C. Martin, Salem, all of Mass.

[73] Assignee: GTE Sylvania Incorporated, Danvers, Mass.

[21] Appl. No.: 614,564

[22] Filed: Sep. 18, 1975

[51] Int. Cl.[2] ..... H01H 85/04

[52] U.S. Cl. ..... 337/20; 337/80; 337/401

[58] Field of Search ..... 335/47, 49, 54; 337/142, 114, 121, 21, 80, 306, 331, 119, 401

[56] References Cited

U.S. PATENT DOCUMENTS

| | | | |
|---|---|---|---|
| 1,228,408 | 6/1917 | Cleaver | 337/21 |
| 2,342,320 | 2/1944 | Ziegel | 337/401 |
| 3,278,713 | 10/1966 | Grupen | 335/49 X |
| 3,289,126 | 11/1966 | Hurvitz | 335/47 |
| 3,341,676 | 9/1967 | Schwarz | 335/49 X |

*Primary Examiner*—George Harris

*Attorney, Agent, or Firm*—James Theodosopoulos

[57] ABSTRACT

An electric switch for thermal overload protection includes a meltable pellet containing a pool of mercury which establishes electrical contact between two lead-in wires. When the pellet is heated to its melting point, the mercury becomes unconfined and the circuit is opened.

2 Claims, 1 Drawing Figure

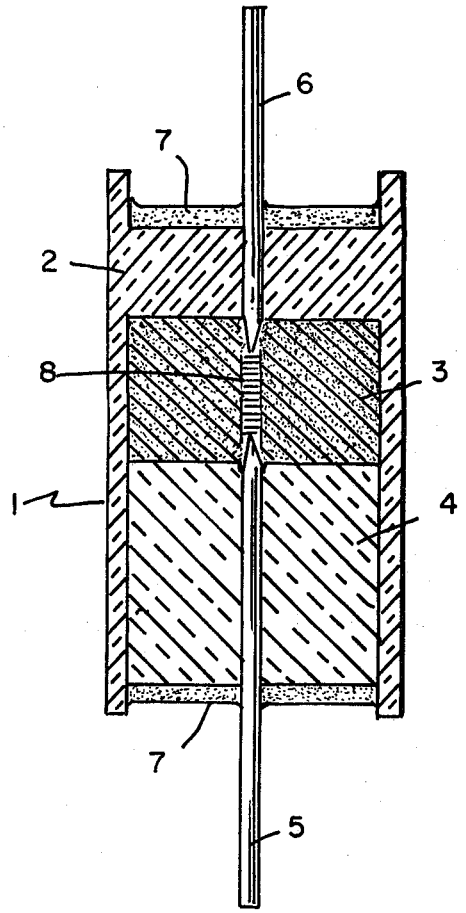
6
7
2
8
3
1
4
7
5

THERMAL FUSE

THE INVENTION

This invention concerns non-resettable protective electric switches of the type that are normally closed but which open when the switch is heated to a predetermined temperature. Such switches are generally used to protect electrical devices and appliances from overheating. When an overheating condition does occur, the opened switch must be removed from the circuit and replaced by a new switch, preferably after the cause of overheating has been corrected. hole in pellet Previously, cycling or bimetal type of thermal protectors have been used to prevent overheating in electrical appliances. However, such protectors have contacts which, after many cycles of operation, can arc and weld themselves together, thereby rendering the protector inoperative.

This invention provides a non-resettable protector switch which must be discarded after it has been tripped. Replacement with a new switch will ensure that the electrical appliance is always protected against overheating.

A switch in accordance with this invention comprises a cylindrical body having lead-in wires extending from each end thereof. Electrical connection between the lead-in wires within the cylindrical body is established by a small pool of mercury confined within a pellet of material having a suitable melting point. Upon attainment of said melting point, the pellet melts and the conductive mercury path is broken, thereby opening the electric circuit between the lead-in wires.

The single FIGURE in the drawing is an expanded sectional view of a thermal switch in accordance with this invention.

In the embodiment shown in the drawing, cylindrical body 1 was made of molded plastic, had an outside diameter of 200 mils, an overall length of 550 mils and an inside diameter of 150 mils except for an intermediate section 2 which had a 31 mil hole 9 therethrough. Disposed within body 1 was a cylindrical pellet 3 of meltable material having a 62 mil hole 10 therethrough. Pellet 3 was 146 mils in diameter by 200 mils long and had a melting point of 238° F but was substantially rigid at temperatures therebelow. Also disposed within body 1, bearing against pellet 3, was a closure plug 4. Plug 4 was molded from a suitable plastic, had a 31 mil hole 11 therethrough, was 146 mils in diameter by 200 mils long. Extending through 11 hole in plug 4 was a 31 mil lead-in wire 5 and extending through 10 hole in section 2 was a 31 mil lead-in wire 6. Hole 10 within pellet 3 was filled with mercury 8 which was in good electrical contact with wires 5 and 6. The ends of body 1 was sealed with a suitable cement 7, for example, epoxy.

In assembling the device lead-in wire 6 is inserted into and slightly through hole 9 in section 2. Meltable pellet 3 is then placed in body 1 against section 2; wire 6 penetrates slightly into hole 10 in pellt 3. Hole 10 in pellet 3 is then filled with mercury 8. Next, lead-in wire 5 is inserted into a closure plug 4 which is then inserted into body 1, bearing against pellet 3. Wire 5 is then pushed in sufficiently to establish firm contact with mercury 8, and both ends are sealed with cement 7 to maintain contact of mercury 8 with both wires 5 and 6.

For reliable electrical contact throughout life of lead-in wires 5 and 6 with mercury 8, the tips of wires 5 and 6 which are in contact with mercury 8 should be prewet with mercury prior to assembly. This can be accomplished by cleaning the wires in dilute hydrochloric acid, then adding mercury to the acid and allowing the mercury to come in contact with the wire tips intermittently until a smooth mirror coating of mercury is obtained thereon. After washing and drying, the wires are ready for assembly.

In operation, the switch is in the circuit of the electric appliance to be protected. When the switch is heated to the melting point of pellet 3, the pellet melts and no longer confines mercury 8 into a conductive path between wires 5 and 6. The mercury, being heavy, settles to the bottom of the space between plug 4 and section 2 into globules and opens the circuit. The circuit being broken, the meltable material of pellet 3 cools and solidifies around the mercury globules, preventing them from remaking the circuit.

We claim:

1. A thermally responsive electric switch comprising an elongated cylindrical body having an integral intermediate section at one end thereof, said section having a small diameter axial hole therethrough; a cylindrical meltable pellet coaxially disposed within said elongated cylindrical body and bearing against said integral intermediate section, said pellet having a small diameter axial hole therethrough; a cylindrical plug coaxially disposed within, and closing off the other end of, said elongated cylindrical body and bearing against said pellet, said plug having a small diameter axial hole therethrough; a lead-in wire extending through the hole in said integral intermediate section and slightly into the hole in said pellet; another lead-in wire extending through the hole in said cylindrical plug and slightly into the hole in said pellet; and a pool of mercury filling the hole in said pellet and in contact with both lead-in wires so as to establish electrical continuity therebetween.

2. The switch of claim 1 wherein the axial hole in said pellet is larger in diameter than the holes in said integral intermediate section and said cylindrical plug.

* * * * *